US006300913B1

(12) United States Patent
Davidson

(10) Patent No.: US 6,300,913 B1
(45) Date of Patent: Oct. 9, 2001

(54) ANTENNA

(75) Inventor: Brian Davidson, Surrey (GB)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

(21) Appl. No.: 09/461,578

(22) Filed: Dec. 15, 1999

(30) Foreign Application Priority Data

Dec. 18, 1998 (GB) ..... 9828019

(51) Int. Cl.[7] ..... H01Q 1/00
(52) U.S. Cl. ..... 343/722; 343/802
(58) Field of Search ..... 343/722, 792, 343/895, 702, 749, 725, 790, 901, 791, 802, 700 MS, 785, 829; 333/219.1

(56) References Cited

U.S. PATENT DOCUMENTS

| | | | | |
|---|---|---|---|---|
| 4,229,743 | * | 10/1980 | Vo et al. | 343/749 |
| 4,730,195 | * | 3/1988 | Phillips et al. | 343/792 |
| 4,772,895 | | 9/1988 | Garay et al. | 343/895 |
| 5,563,615 | * | 10/1996 | Tay et al. | 343/749 |
| 5,691,730 | * | 11/1997 | Egashira et al. | 343/702 |
| 5,771,023 | * | 6/1998 | Engblom | 343/702 |
| 5,990,848 | * | 11/1999 | Annamaa et al. | 343/895 |
| 6,057,807 | * | 5/2000 | Marthinsson et al. | 343/895 |
| 6,147,647 | * | 11/2000 | Tassoudji et al. | 343/700 MS |

FOREIGN PATENT DOCUMENTS

| | | |
|---|---|---|
| 0593185 | 4/1994 | (EP) . |
| 0825672 A2 | 2/1998 | (EP) . |
| WO 97/04496 | 2/1997 | (WO) . |
| WO 97/18601 | 5/1997 | (WO) . |
| WO 97/30489 | 8/1997 | (WO) . |
| WO 98/30038 | 7/1998 | (WO) . |

* cited by examiner

*Primary Examiner*—Don Wong
*Assistant Examiner*—Chuc D Tran
(74) *Attorney, Agent, or Firm*—Perman & Green, LLP

(57) ABSTRACT

An antenna for a mobile communication device, the antenna comprising a housing; a first resonator element with a first feed point having a first resonant frequency; and a second resonator with a second feed point having a second resonant frequency, wherein the housing has an outer portion supporting the first resonator element and an inner portion supporting the second resonator element, the inner portion being positioned within the outer housing such that the first and second feed points are coupled to provide a feed point for the antenna thereby allowing the antenna to operate with the first resonant frequency and the second resonant frequency.

12 Claims, 3 Drawing Sheets

ANTENNA

BACKGROUND OF THE INVENTION

This invention relates to an antenna, and in particular an antenna having two resonant frequencies.

Wireless portable communication devices typically have small antennas to allow ease of use of the communication devices. However, the size of the antenna typically results in the antenna having a narrow operational frequency band.

Some communication devices, however, are required to operate over different frequency ranges which differ significantly from one another. For example, a dual mode radiotelephone may be required to operate over more than one cellular telephone system. One such cellular system is Global System for Mobile Telecommunications (GSM) which operates over the 890 to 960 MHz frequency band while another cellular system that the radiotelephone may be required to operate on is the Personal Communication Network (PCN) which operates over the 1710 to 1880 MHz frequency band.

Antennas designed for radiotelephones are typically made of simple cylindrical coil or helical antennae or whip antennae made from a straight conductor. Where its electrical length, which should be a specific part of the wavelength of the radio frequency used, determines the resonant frequency of an antenna. For radiotelephones the size of the antenna is minimised by choosing an electrical length which is a fraction of the wavelength used. For a helical and whip antennae the electrical length should preferably be $3\lambda/8$ or $\lambda/4$, where $\lambda$ is the wavelength. However, the characteristics of these antennae do not allow the radiotelephone to operate satisfactorily over two different frequency ranges which differ significantly from one another.

One solution to this problem has been to provide radiotelephones with two interchangeable antennae which have different resonant frequencies. Where the user attaches to the radiotelephone the antenna which corresponds to the frequency range of the system in use at any one time. However, continued exchange of the antenna can result in damage to the antenna connector and may cause contact disturbance. Further, a user could easily misplace the antenna currently not in use.

A second solution to this problem has been to attach, during manufacture, two separate antennae to the radiotelephone, each antenna designed to operate over different frequencies. Where the user or radiotelephone selects the antenna according to which system the radiotelephone is operating in. However, this solution increases the complexity of the radiotelephone design and thus increases the manufacturing costs of the radiotelephone.

European Patent 0 825 672 A1 describes an antenna which can operate at two separate frequencies. However, the antenna has three distinct specially designed elements which interact in a complex manner to provide the two frequencies. As such, this increases the complexity of the antenna design.

European Patent 0 593 185 A1 describes an antenna which has two separate resonating elements mounted within a common housing which allows the antenna to operate at two separate frequencies.

SUMMARY OF THE INVENTION

In accordance with an aspect of the present invention there is provided an antenna for a mobile communication device, the antenna comprising a housing; a first resonator element with a first feed point having a first resonant frequency; and a second resonator with a second feed point having a second resonant frequency, wherein the housing has an outer portion supporting the first resonator element and an inner portion supporting the second resonator element, the inner portion being positioned within the outer housing such that the first and second feed points are coupled to provide a feed point for the antenna thereby allowing the antenna to operate with the first resonant frequency and the second resonant frequency.

This invention has the advantage that the first and second resonator elements are supported by a housing that allows certain characteristics of the element to be accurately determined (e.g. the pitch of a resonator element). This invention also allows the antenna to be easily assembled.

This invention provides a dual frequency antenna where each resonant frequency is dependent upon an isolated resonator element. Hence, the antenna frequency characteristic can be determined by simply summing the individual resonator elements frequency characteristics. Therefore, one resonator element can be independently designed to operate over the frequency range of one cellular system and the other resonator element can be independently designed to operate over another cellular system.

Preferably the first resonator element is mounted on the outer portion. This ensures that the housing is interposed between the first and second resonator element. This can aid the de-coupling of the two resonator elements.

Preferably the second element is housed within the volume circumscribed by the outer portion of the housing.

Therefore, with this invention it is possible to design a dual frequency antenna which has substantially the same dimensions as a conventional antenna.

It is desirable that the outer and inner portions of the antenna housing are releasably connected.

This simplifies the manufacturing process and allows a user to replace either the outer or inner portion should it be necessary for the radiotelephone to operate over a different cellular system.

Preferably each of the first or second elements are formed as a helical electrical element.

By using helical elements this has the advantage that the overall size of the antenna can be minimized.

Each electrical element is preferably a monopole. This has the advantage that the length of the element is half that of a corresponding dipole.

By increasing the number of housing portions and correspondingly the number of resonator elements it is also, however, possible for the antenna to have more than two operational frequencies.

In addition a third resonator element with a third feed point having a third resonant frequency is mounted on the antenna housing such that the third feed point is coupled to the first and second feed points to provide a feed point for the antenna thereby allowing the antenna to operate with the first resonant frequency, the second resonant frequency and the third resonant frequency.

For a better understanding of the present invention and to understand how the same may be brought into effect reference will now be made, by way of example only, to the accompanying drawings, in which:

DETAILED DESCRIPTION OF THE INVENTION

Figure 1:
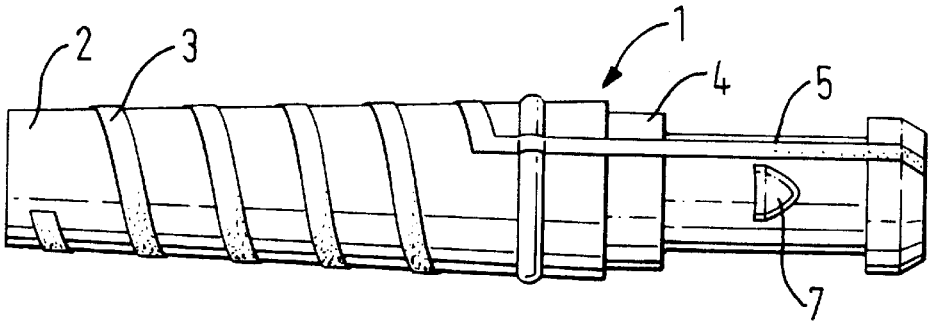
FIG. 1 shows an antenna housing with a helical resonator element in accordance with one embodiment of the present invention.

FIG. 1 shows an antenna housing 1 having a frustoconical part 2 on which is mounted a helical electrically conducting resonator element 3. The resonator element 3 is mounted to the frustoconical part 2, which is made out of an insulating material, by any suitable means. However, a preferred method of mounting is by means of a Moulded Interconnect Device (MID) process as this allows the width and pitch of the resonator element 3 to be accurately determined. The characteristics of the resonator element 3, for example the width, length and pitch, determine the resonant frequency. Accordingly the element characteristics are selected to provide a desired resonant frequency, for example the operating frequency of a specific cellular system.

A person skilled in the art will appreciate that the shape of the frustoconical part 2 can be altered, for example to a cylindrical part. However the characteristics of the resonator element 3 will require modification.

Figure 2:
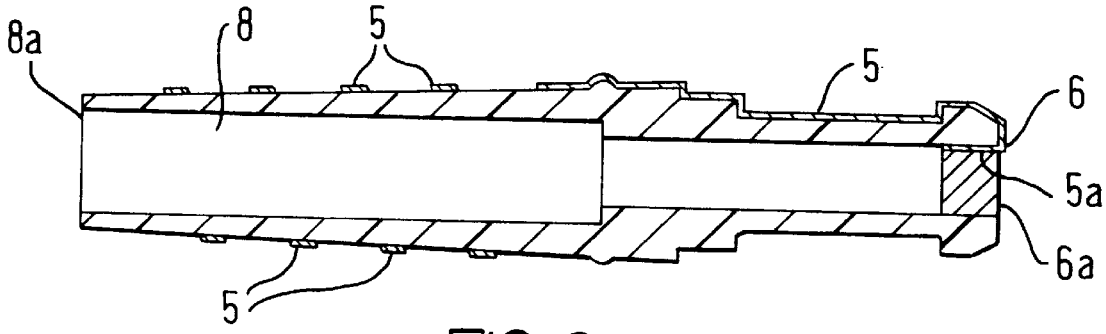
FIG. 2 shows a cross-sectional view of the antenna housing shown in FIG. 1 along the longitudinal axis.

Connected to the frustoconical part 2 and forming part of the antenna housing 1 is a mounting part 4. The mounting part 4 connects the antenna to a mobile communication device, for example a radiotelephone. Mounted on the mounting part 4 is a conductive element 5, which is connected to the resonator element 3 and acts as the feed point for element 3. The feed point 5 can be mounted on the mounting part 4 by any suitable means. However, the preferred method of mounting is by means of the MID process as used to form the resonator 3. The feed point 5 extends along the length of the mounting part 4 and is attached at portion 5*a* at one end to an inner surface 6 of the mounting part 4, as shown in FIG. 2. Accordingly, the resonator element 3 and feed point 5 forms a conductive path which extends from the surface 6 at aperture 6*a* through towards the end of the frustoconical part 2. The frustoconical part 2 and the mounting part 4 are made of an insulating material and preferably form an integral element The mounting part has two radially disposed lugs 7. The lugs 7 are used for securing the housing 1 to a radiotelephone. This will be described in detail below.

FIG. 2 shows a cross section view of the housing 1. The housing 1 has an internal cavity 8.

Figure 3:
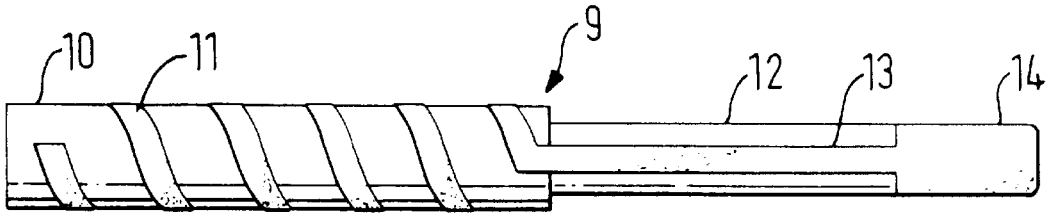
FIG. 3 shows a core antenna element with a helical resonator element.

FIG. 3 shows a second portion 9 of the antenna housing. The second portion 9 fits within the housing cavity 8 forming a core of the antenna. The second portion 9 has an upper cylindrical part 10 on which is mounted a helical electrically conducting resonator element 11. The resonator element 11 is mounted to part 10, which is made out of an insulating material, by any suitable means. The preferred method of mounting element 3 is by the MID process. The characteristics of the resonator element 11, for example the width, length and pitch, can be selected to provide a specified resonant frequency independent of element 3. Accordingly the element characteristics can be selected to provide a desired resonant frequency different to that of element 3, for example the operating frequency of a second cellular phone system.

A person skilled in the art will appreciate that the shape of the cylindrical part 10 can be altered. However the characteristics of the resonator element 11 will require to be modified accordingly.

Connected to the cylindrical part 10 and forming part of the second portion 9 is a connecting part 12. The connecting part 12 in conjunction with the mounting part 4 couples the first portion 1 and the second portion 9 together. Mounted on the connecting part 12 is a conductive element 13 that is connected to the resonator element 11 and acts as the feed point for element 11. The feed point 13 can be mounted on the connecting part 12 by any suitable means. However, the preferred method of mounting resonator element 11 is by means of the MID process. The feed point 13 extends along the length of the connecting part 12 and covers the end portion 14 of the connecting part 12. The connecting part 12 is made of an insulating material.

The cylindrical part 10 is preferably designed to fit snugly within the cavity 8 so ensuring that the overall dimensions of the antenna need be no larger than a conventional stub antenna. However, it is possible to design the cylindrical part 10 so that it extends beyond the volume circumscribed by the first portion.

To assemble the antenna, the second portion 9 is inserted, connecting part 12 first, through aperture 8*a* into cavity 8. Preferably the first and second portions are designed to be connected by means of a push fit. This is achieved by designing the part 6 and the end portion 14 to have an interference fit, such that when the second portion 9 is pushed into the cavity 8 the second portion is releasably connected to the first portion. The interference fit ensures a good conductive path between the feed points mounted in the recess 6 and on the end portion 14. However, any suitable means of coupling the first and second portion, while ensuring a conductive path between the feed points 5, 13, may be used, for example soldering, adhesion, mechanical coupling.

Figure 4:
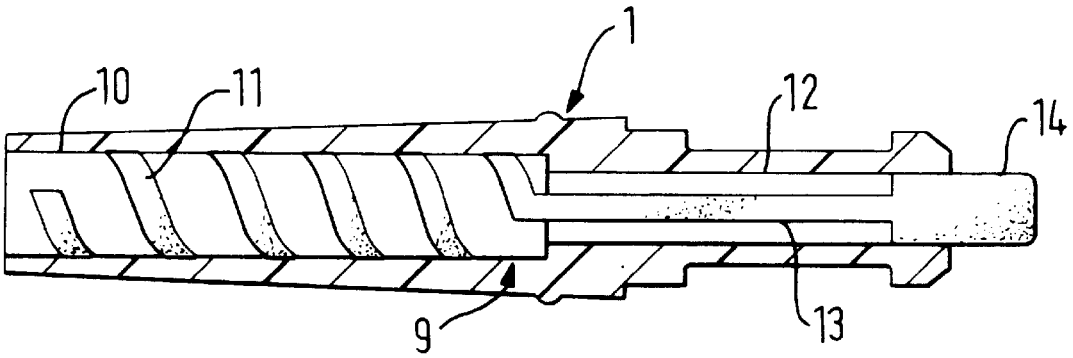
FIG. 4 shows a cross sectional view of an antenna comprising the antenna housing shown in FIG. 1 with the core antenna element inserted.
Figure 5:
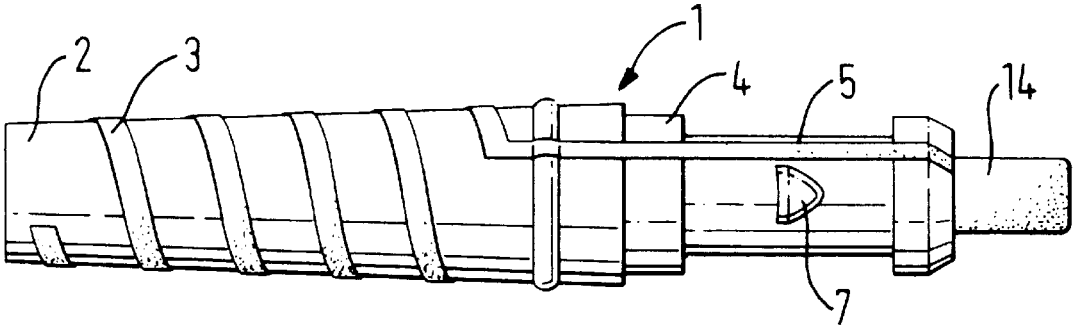
FIG. 5 shows an antenna comprising the antenna housing as shown in FIG. 1 with the core antenna element inserted.

FIGS. 4 and 5 show the second portion 9 fitted within the cavity 8. The end portion 14 extends beyond aperture 6*a* of the first portion 8 to allow the end portion 14 to act as a common connector for both the resonator element 3 and the resonator element 11. When the antenna is mounted in a communication device (not shown) the end portion 14 is coupled to a receiver (not shown) and transmitter (not shown), typically via a duplex filter (not shown). The resonant characteristics of the elements 3, 11 are essentially independent so the antenna resonant frequencies are those of the independent resonator elements 3, 11.

Figure 6:
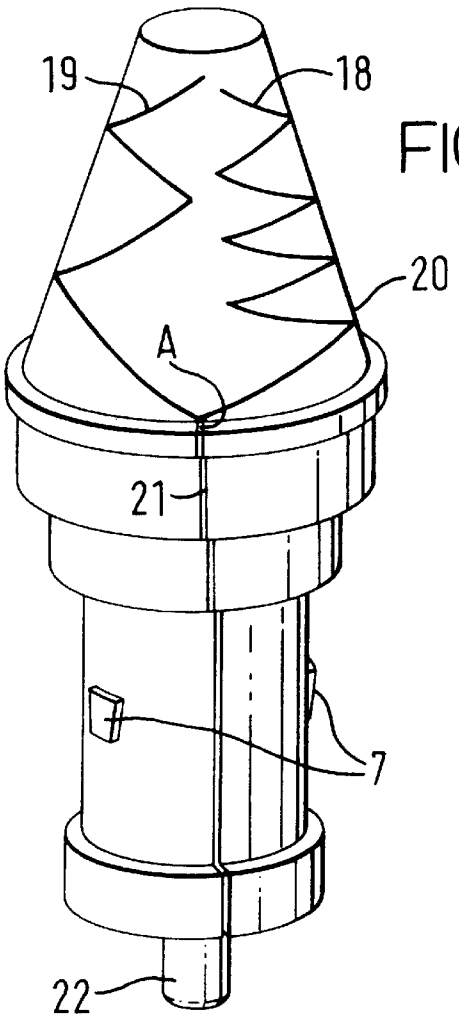
FIG. 6 shows an antenna housing with two resonator elements in accordance with a second embodiment of the present invention.

FIG. 6 shows a second embodiment of the invention in which two electrical resonator elements 18, 19 are housed on the outer surface of the housing 20. The meander path of the resonator elements 18, 19 on the surface of the housing 20 will vary according to the frequency characteristics required. The housing 20 has lugs for mounting the antenna to a radiotelephone.

The elements 18, 19 are coupled at point A which forms a common feed point for both elements 18,19. The feed point 21 extends to a lower portion 22 of the housing in a similar manner to the above embodiment. To increase the number of resonant frequencies of the antenna it is possible to combine this embodiment with the internally mounted embodiment described above.

Preferably a protective sheath (not shown) is placed over the frustoconical part 2, of both embodiments, to protect the resonator element when in use. This sheath protects the resonator elements from damage but provides no mechanical support to the antenna.

Figure 7A:
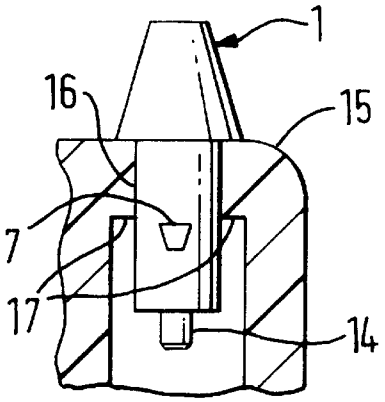
FIGS. 7*a, b* show an antenna according to the present invention mounted on a radiotelephone.
Figure 7B:
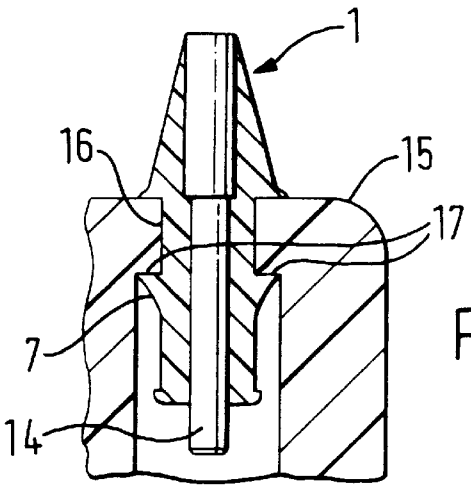

FIGS. 7*a, b* show the antenna mounted in a radiotelephone. The antenna is inserted in an aperture 16 of a radiotelephone 15 with the lugs 7 rotated clear of flanges 17. When the base of frustoconical part 2 is seated on the upper surface of the radiotelephone 15 the antenna housing 1 is rotated about is longitudinal axis until the upper surface of the lugs 7 abut the lower surface of the flanges 17. However, any suitable means of securing the antenna housing 1 to the radiotelephone 15 may be used, for example screw fit, push fit.

The present invention may include any novel feature or combination of features disclosed herein either explicitly or implicitly or any generalisation thereof irrespective of whether or not it relates to the present claimed invention or mitigates any or all of the problems addressed. In view of the foregoing description it will be evident to a person skilled in the art that various modifications may be made within the scope of the invention. For example, it will be appreciated that resonator elements other than helical could be used.

What is claimed is:

1. An antenna for a mobile communication device, the antenna comprising a housing; a first resonator element with a first feed point having a first resonant frequency; and a second resonator with a second feed point having a second resonant frequency, wherein the housing has an outer portion supporting the first resonator element and an inner portion supporting the second resonator element, the inner portion being positioned within the outer housing such that the first and second feed points are coupled to provide a feed point for the antenna thereby allowing the antenna to operate with the first resonant frequency and the second resonant frequency.

2. An antenna according to claim 1, wherein the second resonator element is mounted on the inner portion.

3. An antenna according to claim 1, wherein the first resonator element is mounted on the outer portion.

4. An antenna according to claim 1, wherein the outer housing portion has substantially the same dimensions as a conventional antenna housing.

5. An antenna according to claim 1, wherein the outer and inner portions of the antenna housing are releasably connected.

6. An antenna according to claim 1, wherein one of the first or second resonator elements is formed as a helical electrical element.

7. An antenna according to claim 1, wherein each of the first and second elements are formed as a helical electrical element.

8. An antenna according to claim 1, wherein the first and second resonator elements are co-axially mounted.

9. An antenna according to claim 1, wherein each of the first and second resonator elements is a monopole.

10. An antenna according to claim 1, wherein a third resonator element with a third feed point having a third resonant frequency is supported by the outer housing such that the third feed point is coupled to the first and second feed points to provide a feed point for the antenna thereby allowing the antenna to operate with the first resonant frequency, the second resonant frequency and the third resonant frequency.

11. A mobile communication device having an antenna, the antenna in accordance with claim 1.

12. An antenna according to claim 11, wherein the device is a dual mode radio telephone.

* * * * *